US006634482B1

(12) United States Patent
Miele

(10) Patent No.: US 6,634,482 B1
(45) Date of Patent: Oct. 21, 2003

(54) BILL AND COIN CHECKER

(76) Inventor: Robert J. Miele, 156-24 88th St., Howard Beach, NY (US) 11414

( * ) Notice: Subject to any disclaimer, the term of this patent is extended or adjusted under 35 U.S.C. 154(b) by 73 days.

(21) Appl. No.: 10/051,551

(22) Filed: Jan. 17, 2002

Related U.S. Application Data

(60) Provisional application No. 60/263,449, filed on Jan. 24, 2001.

(51) Int. Cl.[7] ..... G07D 5/00; B07C 5/00

(52) U.S. Cl. ..... 194/328; 73/163; 209/534; 382/135; 382/136; 356/71

(58) Field of Search ..... 194/328, 330, 194/353, 302, 303, 304, 317; 453/3, 4, 17; 73/163; 271/256, 258.01; 209/534; 463/16, 20; 382/135, 136; 356/71, 72

(56) References Cited

U.S. PATENT DOCUMENTS

| | | | | | |
|---|---|---|---|---|---|
| 4,899,392 | A | * | 2/1990 | Merton | 382/136 |
| 5,133,019 | A | * | 7/1992 | Merton et al. | 382/136 |
| 5,220,614 | A | * | 6/1993 | Crain | 382/136 |
| 5,224,176 | A | * | 6/1993 | Crain | 382/136 |
| 6,343,204 | B1 | * | 1/2002 | Yang | 399/366 |
| 6,366,899 | B1 | * | 4/2002 | Kernz | 707/1 |
| 2002/0074209 | A1 | * | 6/2002 | Karlsson | 194/330 |

* cited by examiner

*Primary Examiner*—Donald P. Walsh
*Assistant Examiner*—Mark J Beauchaine
(74) *Attorney, Agent, or Firm*—Robert M. Sperry

(57) ABSTRACT

Improved currency scanners for coins and bills which are connected to computers having memories which contain information concerning coinage or printing errors and scarce coins or bills and which compare each coin or bill as it is scanned to identify and alert the user to such coins or bills.

8 Claims, 1 Drawing Sheet

BILL AND COIN CHECKER

RELATED CASES

This invention is described in my copending Provisional Application Ser. No. 60/263,449, filed Jan. 24, 2001.

FIELD OF INVENTION

This invention relates to currency scanners and is particularly directed to improved means for scanning coins and bills to locate and identify valuable coins and bills.

PRIOR ART

Currency scanners have long been used to verify the authenticity of coins and bills, but have provided no additional information. However, it is well known that many coins and bills have enhanced value beyond their face value, due to errors in printing or coinage or scarcity of the particular coin or bill. Unfortunately nothing has been done heretofore to overcome this problem and people are deprived of considerable amounts of money because they do not recognize or appreciate the true value of their money. Thus, for example, a "lead" penny from World War II could be so corroded that it would look like a conventional copper penny and the owner could pass it thinking it was simply another copper penny when, in fact, it would be worth several dollars. However, most people are unaware of the potential value of such coins and bills and, hence, fail to check their money for such abnormalities and are thereby deprived of substantial amounts of money. Thus, none of the prior art scanning devices have been entirely satisfactory.

BRIEF SUMMARY AND OBJECTS OF INVENTION

These disadvantages of the prior art are overcome with the present invention and improved currency scanners are provided which automatically compare each coin or bill with stored information concerning possible defects or rare items and alerts the person when an unusual coin or bill is located arid, hence, to enable the owner to recover the true value of such coins or bills.

These advantages of the present invention are preferably attained by providing improved currency scanning devices which are connected to computers having memories which contain information concerning coinage or printing errors and scarce coins or bills and which compare each coin or bill as it is scanned to identify and alert the user to coins or bills having enhanced value.

Accordingly, it is an object of the present invention to provide improved currency scanners.

Another object of the present invention is to provide improved currency scanners for coins and bills which will immediately identify rare or unusual coins and bills and will alert the owner that such coins or bills have been located.

A further object of the present invention is to provide improved currency scanners for coins and bills which enable the users to recover the true value of rare or unusual coins or bills.

A specific object of the present invention is to provide improved currency scanners for coins and bills which are connected to computers having memories which contain information concerning coinage or printing errors and scarce coins or bills and which compare each coin or bill as it is scanned to identify and alert the user to such coins or bills.

These and other objects and features of the present invention will be apparent from the following detailed description, taken with reference to the figures of the accompanying drawing.

DETAILED DESCRIPTION OF THE INVENTION

Figure 1:
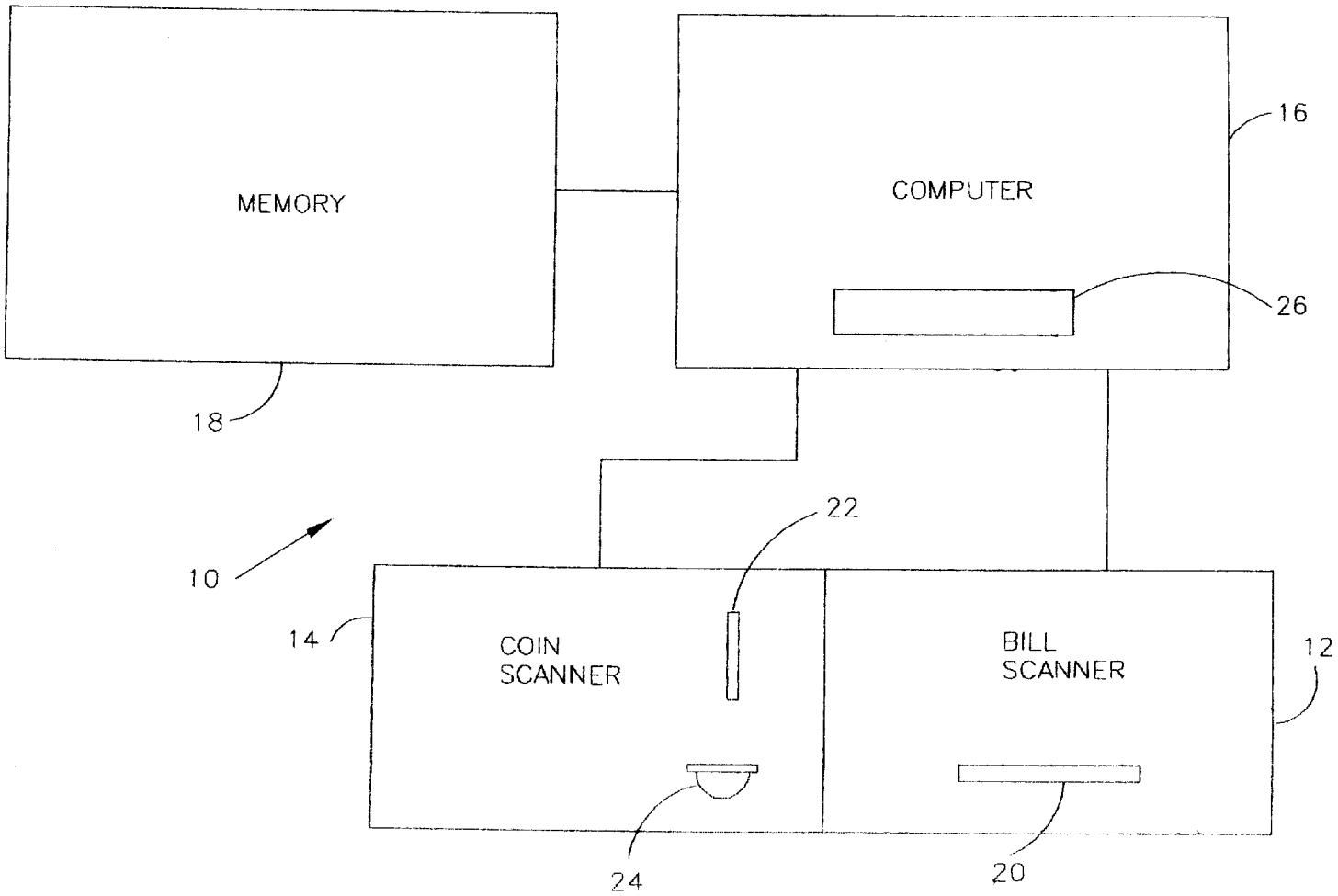
FIG. 1 is a diagrammatic representation of a currency scanner for coins and bills embodying the present invention.

In that form of the present invention chosen for purposes of illustration, FIG. 1 shows a currency scanning device, indicated generally at 10, having a bill scanner 12 and a coin scanner 14 each connected to a computer 16 having a memory 18. The bill scanner 12 includes a slot 20 for inserting and retrieving bills for scanning and the coin scanner 14 includes a slot 22 for inserting coins and a cup 24 for receiving returned coins. The memory 18 contains information concerning coinage and printing errors and scarce coins and bills. Finally, computer 16 contains an indicating panel 26 to provide audible and visible signals when a coin or bill of enhanced value has been located.

In use, a person desiring to determine the true value of their currency inserts a bill into slot 20 of the bill scanner and inserts coins into slot 22 of the coin scanner 14. The scanners 12 and 14 electronically scan the bill and coins and supplies this information to computer 18 which compares the scanned information with data stored in the memory 18. Memory 18 contains data concerning all known coinage and printing errors and those coins or bills which have enhanced value due to scarcity or the like. Computer 16 compares the scanned images of the bills and coins with the data from memory 18 and, if a match is found, the computer 18 provides a signal on indicator panel 26 to alert the user that a coin or bill of enhanced value has been located. If desired, the computer 18 can also provide audible and visible signals to indicate the true value of the identified bill or coin.

Obviously, numerous variations and modifications can be made without departing from the spirit of the present invention. Therefore, it should be clearly understood that the form of the present invention described above and shown in the accompanying drawing is illustrative only and is not intended to limit the scope of the present invention.

What is claimed is:

1. A currency scanning device comprising:

scanning means for electronically scanning currency, a computer having a memory containing data concerning coinage and printing errors, and means for comparing the image from said scanning device with the data contained in said memory and indicating when an item of enhanced value is located.

2. The scanning device of claim 1 wherein:

said scanning means scans coins.

3. The scanning device of claim 1 wherein:

said scanning device scans bills.

4. The scanning device of claim 1 wherein:

said scanning device scans both coins and bills.

5. The scanning device of claim 1 wherein:

said memory also contains data concerning rare and unusual currency.

6. The scanning device of claim 1 wherein:

said last named means provides audible signals when an item of enhanced valued is located.

7. The scanning device of claim 1 wherein:

said last named means provides visible signals when an item of enhanced value is located.

8. The scanning device of claim 1 wherein:

said last named means provides audible and visible signals when an item of enhanced value is located.

* * * * *